US011769624B2

(12) United States Patent
Lee et al.

(10) Patent No.: US 11,769,624 B2
(45) Date of Patent: Sep. 26, 2023

(54) COIL ELECTRONIC COMPONENT

(71) Applicant: SAMSUNG ELECTRO-MECHANICS CO., LTD., Suwon-si (KR)

(72) Inventors: Young Il Lee, Suwon-si (KR); Jeong Gu Yeo, Suwon-si (KR); Ji Hoon Hwang, Suwon-si (KR); Myoung Ki Shin, Suwon-si (KR); Byeong Cheol Moon, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 719 days.

(21) Appl. No.: 16/593,709

(22) Filed: Oct. 4, 2019

(65) Prior Publication Data

US 2020/0203062 A1 Jun. 25, 2020

(30) Foreign Application Priority Data

Dec. 20, 2018 (KR) ..... 10-2018-0166350

(51) Int. Cl.
*H01F 27/24* (2006.01)
*H01F 27/32* (2006.01)
(Continued)

(52) U.S. Cl.
CPC ..... *H01F 27/327* (2013.01); *H01F 27/2804* (2013.01); *H01F 27/292* (2013.01)

(58) Field of Classification Search
CPC .. H01F 27/327; H01F 27/2804; H01F 27/292; H01F 2003/106; H01F 3/10;
(Continued)

(56) References Cited

U.S. PATENT DOCUMENTS

2005/0133116 A1* 6/2005 Nishijima ..... H01F 1/33 148/105
2012/0082844 A1* 4/2012 Takahashi ..... B22F 1/16 428/336
(Continued)

FOREIGN PATENT DOCUMENTS

CN 103180919 A 6/2013
CN 103383886 A 11/2013
(Continued)

OTHER PUBLICATIONS

Korean Office Action dated Oct. 30, 2019 issued in Korean Patent Application No. 10-2018-0166350 (with English translation).
(Continued)

*Primary Examiner* — Mang Tin Bik Lian
*Assistant Examiner* — Mangtin Lian
(74) *Attorney, Agent, or Firm* — Morgan, Lewis & Bockius LLP

(57) ABSTRACT

A coil electronic component includes a body including a coil portion disposed therein, and including a plurality of magnetic particles, and external electrodes connected to the coil portion. The body includes an internal region and a protective layer disposed on a surface of the internal region. A first particle of the plurality of magnetic particles included in the protective layer includes an oxide film disposed on a surface of the first particle, and a second particle, having a size greater than a size of the first particle, of the plurality of magnetic particles includes a coating layer disposed on a surface of the second particle and having a composition different from a composition of the oxide film.

19 Claims, 4 Drawing Sheets

(51) Int. Cl.
*H01F 27/29* (2006.01)
*H01F 27/28* (2006.01)

(58) Field of Classification Search
CPC ..... H01F 2017/048; H01F 17/04; H01F 17/0013; H01F 1/147; H01F 1/33; H01F 27/255
See application file for complete search history.

(56) References Cited

U.S. PATENT DOCUMENTS

2012/0188049 A1 7/2012 Matsuura et al.
2013/0200970 A1* 8/2013 Ogawa ..... H01F 1/22 336/83
2013/0222101 A1 8/2013 Ito et al.
2013/0293334 A1 11/2013 Shin
2014/0286814 A1 9/2014 Kotani et al.
2014/0375413 A1* 12/2014 Kim ..... H01F 1/26 427/127
2015/0002255 A1* 1/2015 Kim ..... H01F 27/255 419/65
2015/0102888 A1* 4/2015 Kim ..... H01F 17/0013 336/200
2015/0235753 A1* 8/2015 Chatani ..... H01F 17/0033 336/200
2015/0380149 A1* 12/2015 Nakamura ..... H01F 41/0206 427/127
2016/0155550 A1* 6/2016 Ohkubo ..... H01F 1/24 336/233
2016/0293321 A1 10/2016 Takeoka et al.
2017/0032880 A1* 2/2017 Jeong ..... H01F 27/292
2017/0236632 A1* 8/2017 Park ..... H01F 27/22 336/55
2018/0005739 A1* 1/2018 Orimo ..... H01F 10/265
2018/0053523 A1* 2/2018 Lisec ..... H01F 41/302
2018/0366246 A1 12/2018 Park et al.
2019/0180895 A1* 6/2019 Ishida ..... H01F 27/2852
2019/0279796 A1* 9/2019 Hosono ..... H01F 1/15333
2019/0279799 A1* 9/2019 Hosono ..... H01F 1/15383
2019/0279801 A1* 9/2019 Yoshidome ..... H01F 1/26
2020/0105447 A1* 4/2020 Nakajima ..... H01F 1/24

FOREIGN PATENT DOCUMENTS

CN 105280335 A 1/2016
CN 108292555 A 7/2018
JP 2016-103598 A 6/2016
JP 2016-195149 A 11/2016
JP 6388426 B2 9/2018
KR 10-1389027 B1 4/2014
KR 10-2015-0083352 A 7/2015
WO 2013/073180 A1 5/2013

OTHER PUBLICATIONS

Chinese Office Action dated Jun. 25, 2021 issued in Chinese Patent Application No. 201911266269.3 (with English translation).

* cited by examiner

COIL ELECTRONIC COMPONENT

CROSS-REFERENCE TO RELATED APPLICATION(S)

This application claims the benefit of priority to Korean Patent Application No. 10-2018-0166350 filed on Dec. 20, 2018 in the Korean Intellectual Property Office, the entire disclosure of which is incorporated herein by reference.

TECHNICAL FIELD

The present disclosure relates to a coil electronic component.

BACKGROUND

As electronic devices such as digital televisions, mobile phones, laptops, and the like, have been designed to have reduced sizes, a coil electronic component applied to such electronic devices has been required to have a reduced size. To meet such demand, a large amount of studies into developing various types of coil-type or thin-film type coil electronic components have been conducted.

An important consideration in developing a coil electronic component having a reduced size is to implement the same properties as before after reducing a size of a coil electronic component. To this end, it may be necessary to increase a content of a magnetic material filling a core. However, there may be a limitation in increasing a content of the magnetic material due to strength of an inductor body, changes in frequency properties caused by insulating properties, and for other reasons.

As an example of manufacturing a coil electronic component, a body may be implemented by layering sheets formed of a mixture of magnetic particles, resin, and the like, on a coil and pressuring the sheets. As the magnetic particles, ferrite, a metal, and the like, may be used. When metal magnetic metal particles are used, it may be preferable to increase a content of the particles in terms of permeability properties of a coil electronic component, but in this case, insulating properties of the body may degrade such that breakdown voltage properties may degrade.

SUMMARY

An aspect of the present disclosure is to provide a coil electronic component having improved breakdown voltage properties by improving insulating properties of a body. The coil electronic component may have improved magnetic properties while reducing a size of the body, as insulating properties of the body improves.

According to an aspect of the present disclosure, a coil electronic component may include a body including a coil portion disposed therein, and including a plurality of magnetic particles, and external electrodes connected to the coil portion. The body includes an internal region and a protective layer disposed on a surface of the internal region. A first particle of the plurality of magnetic particles included in the protective layer may include an oxide film disposed on a surface of the first particle, and a second particle, having a size greater than a size of the first particle, of the plurality of magnetic particles includes a coating layer disposed on a surface of the second particle. The coating layer may have a composition different from a composition of the oxide film and.

The coating layer disposed on the surface of the second particle may be configured as an inorganic coating layer including a P component.

The coating layer may include P-based glass.

A thickness of the coating layer may be 10 to 60 nm.

The coating layer disposed on the surface of the second particle may be configured as an atomic layer deposition layer.

The first particle may include pure iron.

The first particle may have a diameter of 5 μm or less.

The second particle may include an Fe-based alloy.

The second particle may have a diameter of 10 to 25 μm.

A thickness of the protective layer may be 4 to 40 μm.

The oxide film may include an oxide including a metal component included in the first particle.

A thickness of the oxide film may be 200 nm or less.

A partial particle of the plurality of magnetic particles included in the internal region may include an oxide film disposed on a surface of the partial particle.

The oxide film in the internal region may have a thickness less than a thickness of the oxide film of the protective layer.

An amount of the oxide film included in a unit volume of the protective layer may be higher than an amount of the oxide film included in a unit volume of the internal region.

A thickness of the oxide film of the protective layer may decrease from an exterior surface of the protective layer to the internal region.

When the protective layer includes two regions having a same thickness as each other, a thickness of the oxide film in a region adjacent to a surface of the body may be greater than a thickness of the oxide film in a region adjacent to the internal region.

According to another aspect of the present disclosure, a coil electronic component may include a body including a coil portion disposed therein, and including a plurality of magnetic particles, and external electrodes connected to the coil portion, and at least one partial particle of the plurality of magnetic particles included in the body includes an oxide film disposed on a surface of the at least one partial particle, and a thickness of the oxide film of the at least one partial particle adjacent to a surface of the body is greater than a thickness of the oxide film of the at least one partial particle adjacent to an internal region of the body.

The at least one partial particle having the oxide film on a surface thereof may have a diameter of 5 μm or less.

A thickness of the oxide film may be 200 nm or less.

BRIEF DESCRIPTION OF DRAWINGS

The above and other aspects, features, and advantages of the present disclosure will be more clearly understood from the following detailed description, taken in conjunction with the accompanying drawings, in which.

DETAILED DESCRIPTION

Figure 1:
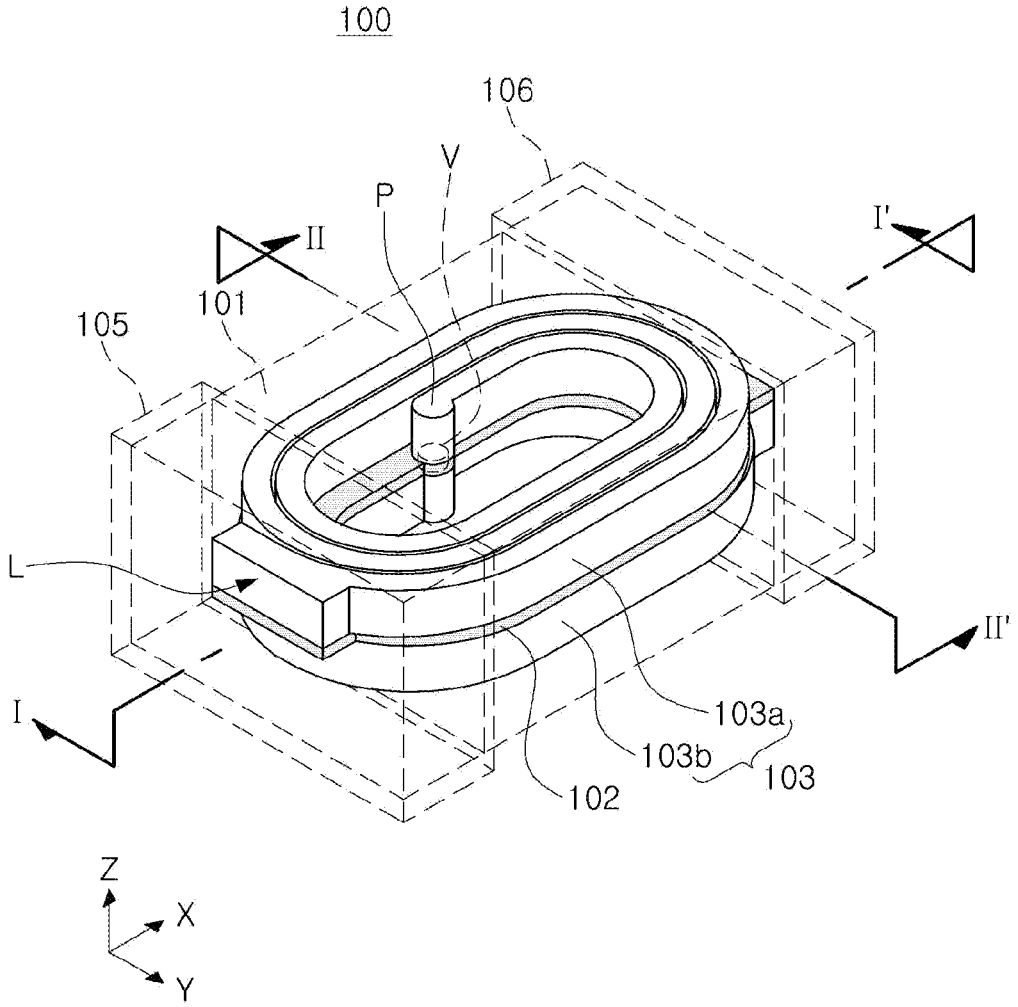
FIG. 1 is a perspective diagram illustrating a coil electronic component according to an exemplary embodiment of the present disclosure.

Hereinafter, exemplary embodiments of the present disclosure will be described as follows with reference to the attached drawings.

The present disclosure may, however, be exemplified in many different forms and should not be construed as being limited to the specific exemplary embodiments set forth herein. Rather, these exemplary embodiments are provided so that this disclosure will be thorough and complete, and will fully convey the scope of the disclosure to those skilled in the art. Accordingly, shapes and sizes of the elements in the drawings can be exaggerated for clear description. Also, elements having the same function within the scope of the same concept represented in the drawing of each exemplary embodiment will be described using the same reference numeral.

Figure 2:
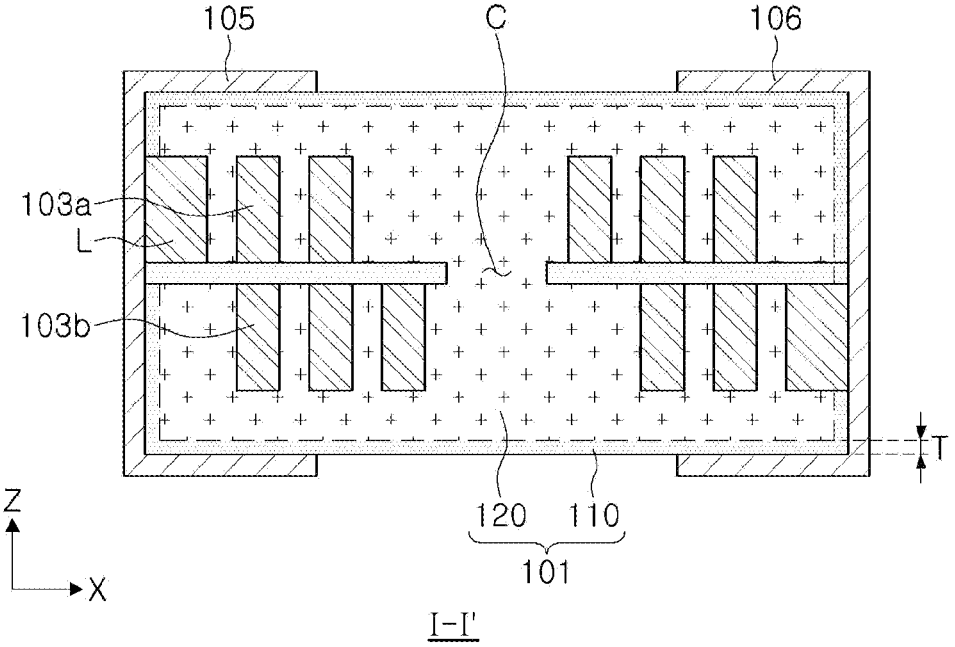
FIGS. 2 and 3 are cross-sectional diagrams illustrating the coil electronic component illustrated in FIG. 1 taken along lines I-I' and II-II' in FIG. 1, respectively.
Figure 3:
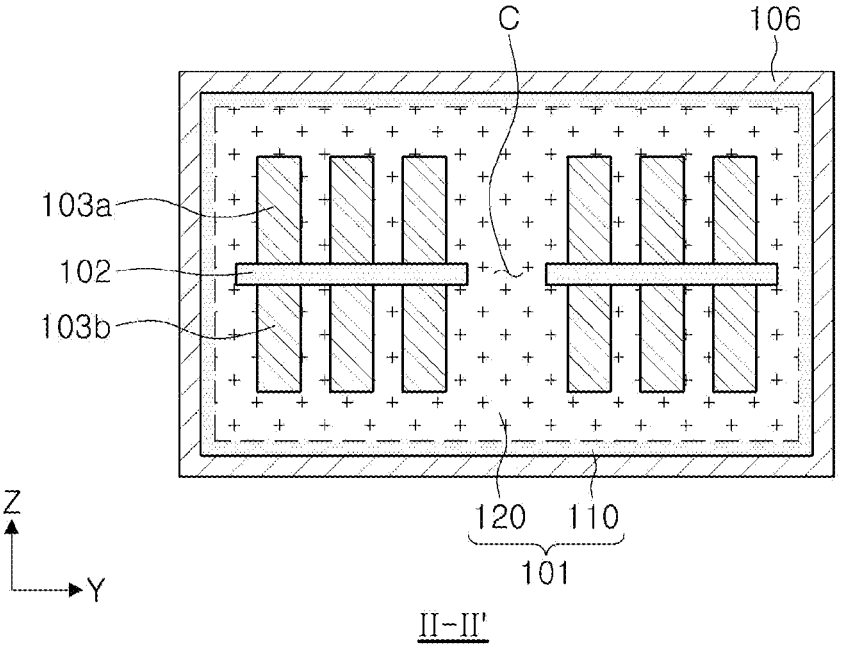
Figure 4:
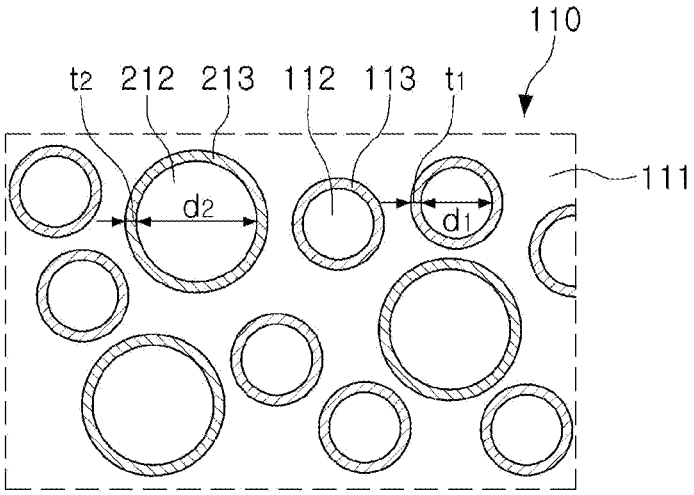
FIGS. 4 and 5 are enlarged diagrams illustrating one regions of a body of a coil electronic component, illustrating one regions of a protective layer and an internal region.
Figure 5:
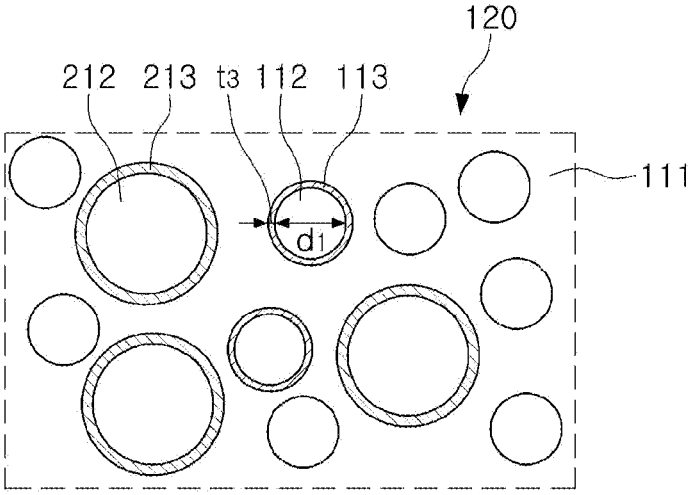
Figure 6:
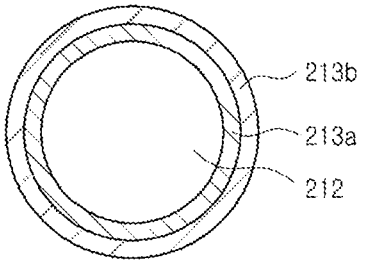
FIG. 6 is an enlarged diagram illustrating a second particle shown in FIGS. 4 and 5 and a coating layer thereof according to an exemplary embodiment of the present disclosure.

FIG. 1 is a perspective diagram illustrating a coil electronic component according to an exemplary embodiment of the present disclosure. FIGS. 2 and 3 are cross-sectional diagrams illustrating the coil electronic component illustrated in FIG. 1 taken along lines I-I' and II-II' in FIG. 1, respectively. FIGS. 4 and 5 are enlarged diagrams illustrating one regions of a body of a coil electronic component, illustrating one regions of a protective layer and an internal region. FIG. 6 is an enlarged diagram illustrating a second particle shown in FIGS. 4 and 5 and a coating layer thereof according to an exemplary embodiment of the present disclosure.

Referring to the diagrams, a coil electronic component 100 in an exemplary embodiment of the present disclosure may include a body 101 may include a body 101, a support substrate 102, a coil portion 103, and external electrodes 105 and 106, and the body 101 may include a plurality of magnetic particles 112 and 212. The body 101 may include an internal region 120 and a protective layer 111 disposed on a surface of the internal region 120. A partial particle 112 (hereinafter, a first particle) may include an oxide film 113 disposed on a surface of the first particle. A partial particle 212 (hereinafter, a second particle) having a size greater than a size of the first particle 112 may include a coating layer 213 having a composition different from a composition of the oxide film 113 and disposed on a surface of the second particle 212. According to an exemplary embodiment of the present disclosure, the second particle 212 may be included as an essential element, but in other exemplary embodiments, the second particle 212 may not be provided.

The body 101 may seal at least portions of the support substrate 102 and the coil portion 103, and may form an exterior of the coil electronic component 100. The body 101 may be configured to externally expose a partial region of a lead-out pattern L. As illustrated in FIGS. 4 and 5, the body 101 may include the plurality of magnetic particles 112 and 212, and the magnetic particles 112 and 212 may be distributed in an insulating material 110. The insulating material 110 may include a polymer component such as a high an epoxy region, a polyimide, and the like.

According to an exemplary embodiment of the present disclosure, the body 101 may include the magnetic particles 112 and 212 having different sizes, thereby increasing the amount of the magnetic particles 112 and 212 included in the body 101. As for the first particle 112 having a relatively small size, the first particle 112 may fill a space between the second particles 212. The first particle 112 may include pure iron, and may have a form of carbonyl iron powder (CIP), for example. A diameter d1 of the first particle 112 may be 5 μm or less.

The oxide film 113 may be disposed on a surface of the first particle 112. For example, as illustrated in FIGS. 4 and 5, the oxide film 113 may be disposed on a surface of the first particle 112 included in the protective layer 110 in the body 101, and the oxide film 113 may also be disposed on a surface of the first particle 112 included in the internal region 120. Alternatively, the oxide film 113 may not be disposed on a surface of the first particle 112 included in the internal region 120. FIG. 4 illustrates an example in which no coating layer is disposed on the first particle 112 which does not include the oxide film 113, but an exemplary embodiment thereof is not limited thereto. A coating layer for protecting the first particle 112 may be formed. For example, the coating layer may be configured as an inorganic coating layer including a P component, or an atomic layer deposition layer. When a coating layer is disposed on a surface of the first particle 112, the oxide film 113 obtained by oxidizing the first particle 112 and the coating layer may form a multilayer structure, and the coating layer 213 and the oxide film 113 may be formed in a mixed manner.

The oxide film 113 on a surface of the first particle 112 may be an oxide of a metal component included in the first particle 112. For example, when the first particle 112 includes pure iron, the oxide film 113 may be an oxide iron ($Fe_2O_3$). Thicknesses t1 and t3 of the oxide film 113 may be 200 nm or less. According to an exemplary embodiment of the present disclosure, the oxide film 113 may be effectively disposed on the first particle 112 of a protective layer 110 forming an external layer of the body 101 by adjusting process conditions for forming the oxide film 113. Accordingly, insulating properties of the protective layer 110 may improve. When insulating properties of the protective layer 110 improve, inductance properties and breakdown voltage (BDV) properties of the coil electronic component 100 may also improve.

Referring to FIGS. 3 and 4, a thickness t3 of the oxide film 113 of the internal region 120 may be less than the thickness t1 of the oxide film 113 of the protective layer 110. An amount of the oxide film 113 included in a unit volume of the protective layer 110 may be higher than a content of the oxide film 113 included in a unit volume of the internal region 120 in the body 101. The oxide film 113 on a surface of the first particle 112 may be formed by performing a heat treatment on the body 101, by exposing the body 101 to ozone, or the like. As the first particle 112 may be more actively oxidized on a surface of the body 101, a greater amount of the oxide film 113 may be disposed on the protective layer 110, an external layer of the body 101, and the protective layer 110 may improve insulating properties of the body 101. That is because, when insulating properties is vulnerable in an external layer of the body 101 adjacent to the external electrodes 105 and 106, breakdown voltage may significantly decrease. Also, when the body 101 is ground to prevent a chipping defect, or other defects, the first particle 112 may be exposed from a surface of the body 101, or a thickness of an insulating film on a surface of the magnetic particle 112 may become uneven. In this case, insulating properties of the body 101 may further degrade. According to an exemplary embodiment of the present disclosure, by forming the protective layer 110 including the oxide film 113 on a surface of the body 101, the above-described issue may be reduced.

A size of the protective layer 110 may be adjusted by changing a heat treatment temperature for forming the oxide film 113 or an ozone concentration. According to the study performed by the inventors, when a thickness T of the protective layer 110 was 4 to 40 μm, improved inductance properties and breakdown voltage properties were secured. When a heat treatment temperature was excessively increased, or a heat treatment time was excessively lengthened, a thickness of the oxide film 113 was increase. Accordingly, although insulating properties improved, inductance property degraded. In this case, as described above, the thicknesses t1 and t3 of the oxide films 113 disposed in the protective layer 110 and the internal region 120 may be 200 nm or less.

As for the protective layer 110 obtained by the above-described method, a size of the oxide film 113 on a surface of the first particle 112 may be varied in different regions. For example, a thickness of the oxide film 113 may decrease from a surface of the protective layer 110 to the internal region 120. Also, when the protective layer 110 is divided into two regions having the same thickness, a thickness of the oxide film 113 in a region disposed on a surface may be greater than a thickness of the oxide film 113 in a region disposed adjacent to the internal region 120. That is because, as described above, the oxide film 113 may have a greater thickness on a surface of the body 101.

The second particle 212 having a relatively great size may include an Fe-based alloy, or the like. For example, the second particle 212 may include a nanocrystalline particle boundary alloy having a composition of Fe—Si—B—Cr, an Fe—Ni based alloy, and the like. A diameter d2 of the second particle 212 may be 10 to 25 μm. When a portion of the magnetic particle includes an Fe-based alloy as described above, magnetic properties such as permeability may improve, but the magnetic particle may be vulnerable to electrostatic discharge (ESD). Accordingly, a coating layer 213 may be disposed on a surface of the second particle 212. The coating layer 213 may have a composition different from a composition of the oxide film 113 of the first particle 112.

According to the study conducted by the inventors, the oxide film 113 was selectively formed only on a surface of the first particle 112 during a process of oxidizing the body 101, and the oxide film was not disposed on the second particle 212, or a small amount of oxide film was formed. When a small amount of oxide film is disposed on the second particle 212, a thickness of the second particle 212 may be less than a thickness of the oxide film 113 of the first particle 112. The oxide film of the second particle 212 may refer to an oxide film disposed on a surface of the second particle 212 or a surface of the coating layer 213. When the body 101 is oxidized by a heat treatment process, the oxide film 113 started being disposed on the first particle 112 having a relatively small size within a temperature range of 100 to 200° C., a relatively low temperature, whereas the second particle 212 started being oxidized at 500° C. or higher, a temperature significantly higher than the above-mentioned temperature. In the temperature in which the second particle 212 is oxidized, damage may be applied to the insulating material 110, and others. Accordingly, the body 101 may be oxidized in a temperature lower than the above-mentioned temperature, thereby selectively oxidizing the first particle 112.

The coating layer 213 on a surface of the second particle 212 may be configured as an inorganic coating layer including a P component. For example, the coating layer 213 may include P-based glass. The P-based inorganic coating layer may include elements such as P, Zn, Si, and the like, and may include oxides of the elements. When the coating layer 213 is configured as a P-based inorganic coating layer, a thickness t2 of the coating layer 213 may be 10 to 60 nm.

The coating layer 213 on a surface of the second particle 212 may also be configured as an atomic layer deposition (ALD) layer. The atomic layer deposition may be a process of uniformly coating a surface of an object in atomic layer level by surficial chemical reaction during a process of periodically supplying and discharging a reacting material. The coating layer 213 obtained by the above-described process may have a reduced and uniform thickness and improved insulating properties. Accordingly, even when the body 101 is filled with a large amount of the second particle 212, insulating properties of the body 101 may be effectively secured. When the coating layer 213 is configured as an atomic layer deposition layer, a thickness of the coating layer 213 may be reduced such that a size of the body 101 may be reduced, and a thickness of the coating layer 213 may be 10 to 15 nm. Also, when the coating layer 213 is configured as an atomic layer deposition layer, the coating layer 213 may include alumina ($Al_2O_3$), silica ($SiO_2$), and the like. The coating layer 213 may also include various materials formed by an atomic layer deposition other than the above-mentioned materials. For example, the coating layer 213 may include materials such as $TiO_2$, $ZnO_2$, $HfO_2$, $Ta_2O_5$, $Nb_2O_5$, $Sc_2O_3$, $Y_2O_3$, MgO, $B_2O_3$, $GeO_2$, and the like. According to exemplary embodiments of the present disclosure, as illustrated in FIG. 6, the coating layer 213 may have a multilayer structure including an P-based inorganic coating layer 213*b* and an atomic layer deposition layer 213*a*.

As an example of a method of manufacturing the body 101, the body 101 may be formed by a layering process. For example, the coil portion 103 may be disposed on the support substrate 102 using a plating process, and the like, a plurality of unit laminates for manufacturing the body 101 may be prepared, and the unit laminates may be stacked. The unit laminates may be manufactured by making a slurry using a mixture of the magnetic particles 112 and 212 including a metal and organic materials such as a thermosetting resin, a binder, a solvent, and the like, coating a carrier film with the slurry in thickness of several tens of μm using a doctor blade method, drying the slurry, and manufacturing the unit laminates in sheet form. Accordingly, the manufactured unit laminate may include magnetic particles distributed in a thermosetting resin such as an epoxy resin, a polyimide, or the like. A plurality of the unit laminates may be formed, and the unit laminates may be stacked in an upper portion and a lower portion of the coil portion 103 and may be pressured, thereby implementing the body 101. The oxide film 113 may be disposed on the magnetic particle 112 present in the body 101 through an oxidization process as described above, and in this case, a relatively thinner oxide film 113 may be disposed on the magnetic particle 112 of the internal region 120, or the oxide film 113 may not be disposed on the magnetic particle 112 of the internal region 120.

The other elements will be described with reference to FIGS. 1 to 3. The support substrate 102 may support the coil portion 103, and may be implemented as a polypropylene glycol (PPG) substrate, a ferrite substrate or a metal-based soft magnetic substrate, and the like. As illustrated in the diagram, a through-hole may be formed in a central portion of the support substrate 102, penetrating the support substrate 102, and the through-hole may be filled with the body 101, thereby forming a magnetic core portion C. According to exemplary embodiments of the present disclosure, the support substrate 102 may not be provided.

The coil portion 103 may be disposed in the body 101, and may perform various functions in an electronic device through properties implemented by coils of the coil electronic component 100. For example, the coil electronic component 100 may be implemented as a power inductor, and in this case, the coil portion 103 may stabilize power by storing electricity in a form of a magnetic field and maintaining an output voltage. Coil patterns included in the coil portion 103 may be layered on both surfaces of the support substrate 102, and may be electrically connected through a conductive via V penetrating the support substrate 102. The coil portion 103 may be formed in spiral form, and a lead-out portion T may be included in an outermost region of the spiral form for electrical connection with the external electrodes 105 and 106.

The coil portion 103 may be disposed on at least one of a first surface (an upper surface in FIG. 2) and a second surface (a lower surface in FIG. 2) of the support substrate 102 opposing each other. According to an exemplary embodiment of the present disclosure, the coil portion 103 may be disposed on both of the first surface and the second surface of the support substrate 102, and in this case, the coil portion 103 may include a pad region P. Alternatively, the coil portion 103 may be disposed on only one of surfaces of the support substrate 102. The coil pattern included in the coil portion 103 may be formed using a plating process used in the respective technical field, such as a pattern plating process, an anisotropic plating process, an isotropic plating process, or the like, and may be configured to have a multilayer structure using a plurality of processes among the above-mentioned processes.

The external electrodes 105 and 106 may be disposed externally on the body 101 and may be connected to the lead-out pattern L. The external electrodes 105 and 106 may be formed using a paste including a metal having high electrical conductivity, and the paste may be a conductive paste including one of nickel (Ni), copper (Cu), tin (Sn) or silver (Ag), or alloys thereof, for example. Each of the external electrodes 105 and 106 may further include a plating layer (not illustrated) disposed thereon. In this case, the plating layer may include one or more elements selected from a group consisting of nickel (Ni), copper (Cu), and tin (Sn). For example, a nickel (Ni) plating layer and a tin (Sn) plating layer may be formed in order.

According to the aforementioned exemplary embodiments, in the coil electronic component, breakdown voltage properties may improve as insulating properties of the body improves.

While the exemplary embodiments have been shown and described above, it will be apparent to those skilled in the art that modifications and variations could be made without departing from the scope of the present disclosure as defined by the appended claims.

What is claimed is:

1. A coil electronic component, comprising:

a body including a coil portion disposed therein, and including a plurality of magnetic particles; and external electrodes connected to the coil portion, wherein the body includes an internal region and a protective layer disposed on a surface of the internal region, and wherein a first particle of the plurality of magnetic particles included in the protective layer includes an oxide film disposed on a surface of the first particle, and a second particle, having a size greater than a size of the first particle, of the plurality of magnetic particles includes a coating layer disposed on a surface of the second particle, the coating layer having a composition different from a composition of the oxide film, the oxide film is in contact with the first particle and the coating layer is in contact with the second particle, the coating layer disposed on the surface of the second particle includes a phosphorus element, and the oxide film of the first particle does not include a phosphorus element.

2. The coil electronic component of claim 1, wherein the coating layer includes glass.

3. The coil electronic component of claim 1, wherein a thickness of the coating layer is 10 to 60 nm.

4. The coil electronic component of claim 1, wherein the first particle includes pure iron.

5. The coil electronic component of claim 1, wherein the first particle has a diameter of 5 μm or less.

6. The coil electronic component of claim 1, wherein the second particle includes an Fe-based alloy.

7. The coil electronic component of claim 1, wherein the second particle has a diameter of 10 to 25 μm.

8. The coil electronic component of claim 1, wherein a thickness of the protective layer is 4 to 40 μm.

9. The coil electronic component of claim 1, wherein the oxide film includes an oxide including a metal component included in the first particle.

10. The coil electronic component of claim 1, wherein a thickness of the oxide film is 200 nm or less.

11. The coil electronic component of claim 1, wherein a partial particle of the plurality of magnetic particles included in the internal region includes an oxide film disposed on a surface of the partial particle.

12. The coil electronic component of claim 11, wherein the oxide film in the internal region has a thickness less than a thickness of the oxide film of the protective layer.

13. The coil electronic component of claim 11, wherein an amount of oxides of the oxide film included in a unit volume of the protective layer is greater than an amount of oxides of the oxide film included in a unit volume of the internal region.

14. The coil electronic component of claim 1, wherein a thickness of the oxide film of the protective layer decreases in a direction from the protective layer to the internal region.

15. The coil electronic component of claim 1, wherein, when the protective layer includes two regions having a same thickness as each other, a thickness of the oxide film in a region adjacent to a surface of the body is greater than a thickness of the oxide film in a region adjacent to the internal region.

16. The coil electronic component of claim 1, wherein the coating layer disposed on the surface of the second particle has a multilayer structure including a P-based inorganic coating layer and an atomic layer deposition layer.

17. A coil electronic component, comprising:

a body including a coil portion disposed therein, and including a plurality of magnetic particles; and external electrodes connected to the coil portion, wherein the plurality of magnetic particles comprises first partial particles disposed adjacent to a surface of the body and including oxide films directly disposed on respective surfaces of the first partial particles, and second partial particles disposed adjacent to an internal region of the body and including oxide films directly disposed on respective surfaces of the second partial particles, and an average thickness of the oxide films of the first partial particles adjacent to the surface of the body is greater than an average thickness of the oxide films of the second partial particles adjacent to the internal region of the body, wherein each of the oxide films of the first partial particles adjacent to the surface of the body and the oxide films of the second partial particles adjacent to the internal region of the body is an only oxide film disposed on a corresponding particle.

18. The coil electronic component of claim 17, wherein at least one of the first partial particles or at least one of the second partial particles has a diameter of 5 μm or less.

19. The coil electronic component of claim 17, wherein a thickness of the oxide film disposed on at least one of the first partial particles or at least one of the second partial particles is 200 nm or less.

* * * * *